US005154329A

United States Patent [19]

Dorfmueller

[11] Patent Number: 5,154,329

[45] Date of Patent: Oct. 13, 1992

[54] CONFIGURED SHIRT-SHAPER ARTICLE FOR FOLDING SHIRTS

[76] Inventor: Daniel P. Dorfmueller, 53 Illona Dr., Cincinnati, Ohio 45218

[21] Appl. No.: 790,511

[22] Filed: Nov. 12, 1991

[51] Int. Cl.[5] ..... A41H 33/00; B65D 81/24

[52] U.S. Cl. ..... 223/37; 223/87; 206/292; 206/296; 206/297; 206/293

[58] Field of Search ..... 223/87, 37, 38; 206/288, 292, 293, 295, 296, 297, 299

[56] References Cited

U.S. PATENT DOCUMENTS

| | | | |
|---|---|---|---|
| 703,110 | 6/1902 | Beiermeister | 223/37 |
| 1,657,551 | 1/1928 | Schremp | 223/37 |
| 1,873,954 | 8/1932 | Cooper | 223/37 |
| 2,418,755 | 4/1947 | Campbell | 223/37 |
| 2,508,579 | 5/1950 | McFall | 206/292 |
| 2,855,649 | 10/1958 | Kanter | 223/87 |
| 3,688,948 | 9/1972 | Roda | 206/292 X |
| 4,190,151 | 2/1980 | Russell | 223/87 X |
| 4,994,417 | 7/1990 | Datlow | 223/87 X |
| 5,011,052 | 4/1991 | Craig | 223/37 |

FOREIGN PATENT DOCUMENTS

| | | | |
|---|---|---|---|
| 2749818 | 5/1979 | Fed. Rep. of Germany | 206/292 |
| 2929392 | 2/1981 | Fed. Rep. of Germany | 206/292 |

*Primary Examiner*—Werner H. Schroeder
*Assistant Examiner*—Bibhu Mohanty
*Attorney, Agent, or Firm*—Charles R. Wilson

[57] ABSTRACT

A configured shirt-shaper article is used for the convenient folding and storing of a shirt in a substantially wrinkle-free state. The article is substantially flat and configured to have a generally rectangular-shaped main member with arm members extending from each upper corner area of the main member. A first fold line and a second fold line each extend longitudinally along one side and the other side respectively of the main member to divide the main member into two substantially equal side sections and a mid-section. The article is initially positioned inside the shirt. Next, the side sections with overlying shirt are folded to lie adjacent the back of the shirt. Finally, the bottom portion of the shirt is folded preferably backwardly to form a precisely and neatly folded shirt.

14 Claims, 2 Drawing Sheets

CONFIGURED SHIRT-SHAPER ARTICLE FOR FOLDING SHIRTS

This invention relates to a configured article for use with a shirt. More particularly, the invention relates to a configured article useful for the convenient folding and storing of a shirt in a substantially wrinkle-free state.

Anyone who has ever traveled has faced the task of folding certain garments such as dress shirts, casual shirts and blouses. These garments, of course, are irregularly shaped and are not conducive to folding into a neat compact unit convenient for packing in a suitcase. The traveler must fold the garment in a manner which seems practical. The result, quite often, is frustration initially in trying to fold the garment into a compact unit which gives some promise that wrinkles will not occur. The frustration is only heightened when the traveler unpacks and discovers the garment in a wrinkled state unsuitable for immediate wearing. This is annoying to the occasional traveler; it is upsetting to the frequent traveler.

The recognized problem of packing certain garments has resulted in the development and sale of articles designed to solve the problem. Full length carry bags with shoulder straps is an example of one article which allows dresses, suits and shirts to remain on a hanger and be transported in a relatively wrinkle-free state. Unfortunately, the carry bags are bulky and difficult to transport. They have proved to be a nuisance to many travelers. Other compact rigid or semi-rigid carry cases designed to hold only shirts and blouses have proved costly and cumbersome to use. Additionally, the problem of initially folding the garment to a compact unit size remains.

Another solution to the problem has been to accept the fact a garment cannot be packed so as to remain in a substantially wrinkle-free state; consequently, a portable iron is needed to iron out the garment wrinkles at the place of destination. Certainly, the need to pack and carry a bulky iron is less than ideal. Moreover, the initial problem of folding the garment to a neat compact state to facilitate full use of a suitcase's capacity remains.

In accord with a demonstrated need, there has been developed an inexpensive, though effective article for folding and storing shirts. The article provides a convenient means to neatly and precisely fold the shirt in a manner where it remains in a substantially wrinkle-free state during storage.

SUMMARY OF THE INVENTION

A configured shirt-shaper article having a substantially flat body comprises a main member, two arm members and a neck member. The article is dimensioned and configured to fit inside a shirt to aid in folding of the shirt. The main member has a first fold line extending longitudinally along one side and a second fold line extending longitudinally along a second side. Once the article is properly positioned in a shirt, the shirt is readily folded using the article's peripheral edges and fold lines into a compact shape which is convenient for packing and storing in a substantially wrinkle-free state.

DETAILED DESCRIPTION OF THE INVENTION

The shirt-shaper article of the invention and its use is described with particular reference to the drawings. While use of the article is described in conjunction with folding a long sleeve shirt, it should be understood the article is useful with shirts of all natures. As used herein, the term is used in its broadest context to include men's dress shirts and casual shirts and women's blouses. Shirts of different sleeve lengths and styles, button and buttonless are included.

Figure 1:
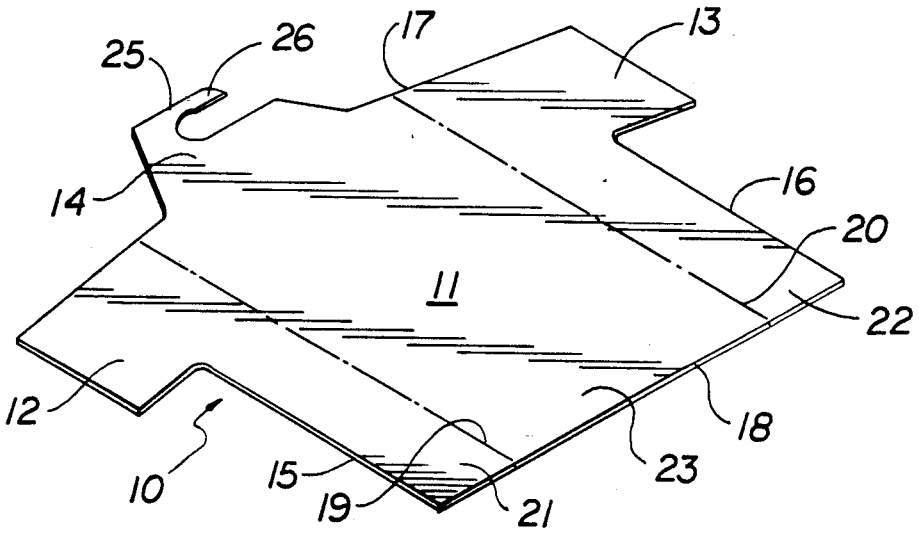
FIG. 1 is a perspective view of the shirt-shaper article of the invention.

With reference to FIG. 1 the shirt-shaper article 10 has a substantially flat body with a particularly configured outline. The article is made of a durable, inexpensive light weight material. An about 0.5 millimeter to about 4 millimeter cardboard is preferred. Other rigid and semi-rigid materials such as plastic and leather can as well be used.

The article 10 is configured and dimensioned to fit inside the shirt to be folded. The article is generally configured as a short sleeve shirt and comprises defined members as described below. Preferably, the width of the body of the article is two to four inches less than the width of a typical shirt to allow the article to be readily slid through the buttoned or snapped shirt from the shirt's open bottom. Preferably, the length of the article ranges from about twelve to twenty inches in length, though can be longer if an extra long folded shirt can be tolerated. Typically, however, the length of the article is about one-half the length of a typical shirt to allow for a single lateral folding step to produce a compact folded shirt ready for packing in a suitcase or shelf.

The shirt-shaper article 10 is comprised of a main member 11, a first arm member 12, a second arm member 13 and a neck member 14. The main member 11 is generally rectangular-shaped with the sides defined by side edges 15 and 16, upper edge 17 and lower edge 18. Preferably, the main member ranges from about twelve inches to about twenty inches in length and from about ten inches to about eighteen inches in width.

A set of fold lines 19 and 20 extend longitudinally along the main member 12 from the upper edge 17 to the lower edge 18. Each fold line is straight and is such that the side sections 21 and 22, defined by a respective side edge and fold line, are able to fold 180 degrees to lie flat against a mid-section 23, as defined by the two fold lines. Each fold line is positioned about two inches to about four inches from a side edge to form two approximately equal side sections and a mid-section. The mid-section has a width suitable for forming a compact folded shirt. The width of the mid-section and each side section when positioned in a shirt are such that the shirt is ultimately folded into three sections lengthwise.

The article 10 further has arm members 12 and 13. Each arm member is generally rectangular-shaped and extends laterally from an upper corner area of the main member. Preferably, each arm member extends laterally at a slight downward angle to best accommodate the shirt. The length of the arm members must be such as to allow a ready positioning of the article inside a flattened shirt. The arm members 12 and 13 are about two inches to about four inches in length and about four inches to about six inches in width.

The neck member 14 extends from a center area of the main member 11's top edge and is dimensioned to extend out of the neck opening of the shirt. For positioning purposes, the side edges of the neck member are angled inwardly. The neck member 14 is about one inch to about two inches in length and about five inches to about eight inches in width.

In a preferred embodiment of the invention a hook-like member extends from the neck member 14. Its purpose is to provide a means whereby the shirt-shaper article with or without the shirt on it can be hung on a closet clothes rod. This permits a convenient manner of storing the article either during non-use or when away from home. The hook-like member 25 has a leg 26 which overlies the clothes rod with an underside curved inwardly to provide an end portion to retain the article in position on the rod.

Figure 2:
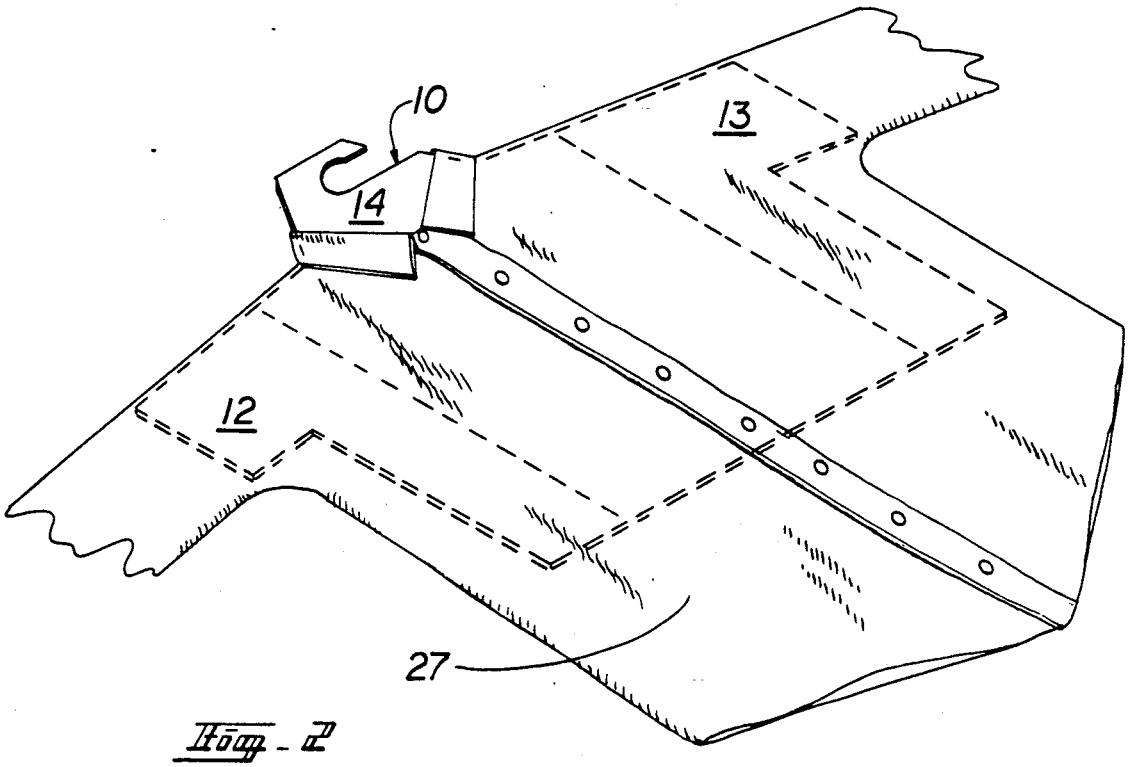
FIG. 2 is a perspective view of a shirt with the shirt-shaper article of FIG. 1 positioned inside the shirt and shown partly in phantom.
Figure 3:
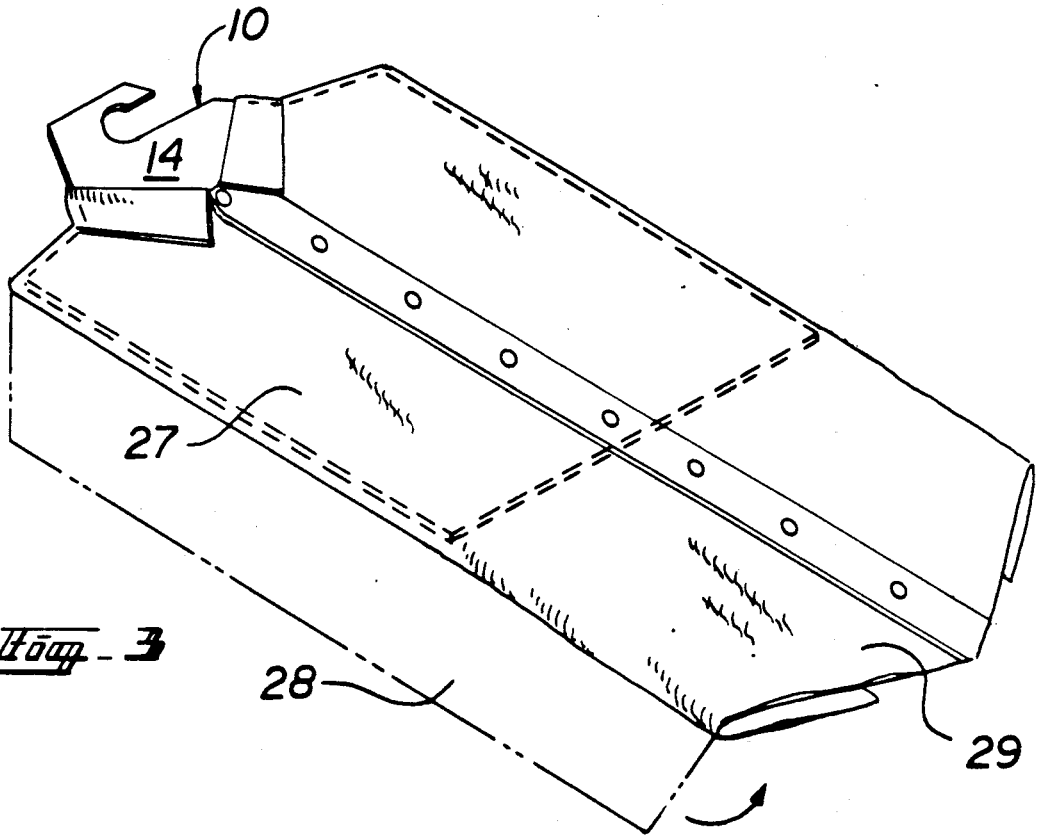
FIG. 3 is a perspective view of the shirt-shaper article and shirt of FIG. 2 after a partial sequence of folding steps.
Figure 4:
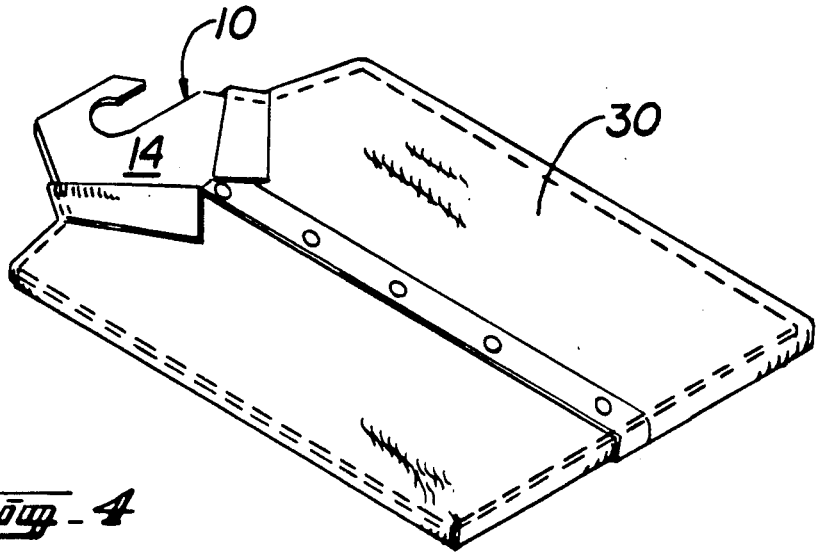
FIG. 4 is a perspective view of the shirt-shaper article and shirt of FIG. 2 in a fully folded state ready for packing or storing.

FIGS. 2–4 illustrate the use of the shirt-shaper article 10. As shown in FIG. 2, the article 10 is positioned inside the shirt 27 and is shown partially in phantom. The article is slipped into a fully buttoned shirt from the bottom or is laid in an opened shirt and the shirt subsequently buttoned. The article is positioned so that the neck member 14 extends out the shirt's neck opening and the article's top edge is adjacent the shirt's center shoulder line. The arm members 12 and 13 extend partially into the shirt's sleeves.

With reference to FIG. 3, the side sections of the main member are folded down to revolve 180 degrees. Necessarily, each shirt sleeve and shirt side 28 is forced to follow and lie flat along the back side of the shirt. Next, as shown in FIG. 4, the shirt bottom 29 is folded laterally 180 degrees to lie adjacent the folded-under shirt sleeves.

The resultant fully folded shirt 30 is in a substantially flattened compact state. As such, it is readily packed into a suitcase or stored on a shelf. Most importantly, the shirt is in a folded state such that it remains substantially wrinkle-free while packed or stored, especially the front shirt portion which is most noticed. Optionally, a semi-permanent strap or tape can be used to encircle the folded shirt to retain it in the folded state. The shirt-shaper article with the shirt unfolded, though still positioned thereon can be hung in a closet. This feature of the invention is particularly useful to the traveler who anticipates a prolonged stay and wishes to unpack several shirts at the place of destination.

Various aesthetic features such as colorings and scents can be incorporated into the article. Printed advertising materials or other messages can as well be placed on the article. Use of hinges in place of the fold lines is also feasible, though does add substantial cost to the article and detracts from its ease of use.

It should be apparent that the shirt-shaper article can be utilized by a shirt manufacturer at the factory. Thus, the manufacturer can use the shirt-shaper article in packaging the shirt in place of presently used stiffener materials. The packaged shirt as such is likely to catch the eye of the consumer and, as such, enjoys a competitive advantage over other packaged shirts.

While the invention has been described with particular reference to the drawings, it should be apparent that various modifications can be made to the shirt-shaper article. All modifications of an obvious nature are considered within the scope of the appended claims.

I claim:

1. A shirt-shaper article for positioning inside a flattened shirt for use in the convenient folding and storage of the shirt in a substantially wrinkle-free state, said article being a substantially flat body generally configured as a short sleeve shirt having:

(a) a generally rectangular-shaped main member with a first fold line extending longitudinally along one side of said main member from a top edge thereof to a bottom edge thereof and a second fold line extending longitudinally along another side of said main member from the top edge thereof to the bottom edge thereof, said first and second fold lines dividing said main member into two approximately equal side sections and a mid-section wherein the generally rectangular-shaped main member is dimensioned to readily fit inside the flattened shirt when buttoned;

(b) a first generally rectangular-shaped arm member extending laterally from an upper corner of one side section of the main member and a second generally rectangular-shaped arm member extending laterally from an upper corner of the other side section of the main member wherein each said arm member is dimensioned to accommodate a sleeve of the shirt by extending into said sleeve; and (c) a neck member included in said flat body extending from a center area of the main member's top edge to accommodate to neck opening of the shirt.

2. The shirt-shaper article of claim 1 wherein the main member ranges from about twelve inches to about twenty inches in length and about ten inches to about eighteen inches in width.

3. The shirt-shaper article of claim 2 wherein each fold line is positioned about two inches to about four inches from a side edge.

4. The shirt-shaper article of claim 3 further having a hook-like member extending from a center area of the neck member, said hook-like member capable of hooking over a closet rod to suspend the shirt-shaper therefrom.

5. The shirt-shaper article of claim 1 wherein the substantially flat body is a rigid or semi-rigid material.

6. The shirt-shaper article of claim 5 wherein the substantially flat body is formed from cardboard, plastic, or leather.

7. The shirt-shaper article of claim 6 wherein the substantially flat body is an about 0.5 millimeter to about 4 millimeter cardboard.

8. A shirt-shaper article for positioning inside a flattened shirt for use in the convenient folding and storage of the shirt in a substantially wrinkle-free state, said article being a substantially flat body having:

(a) a generally rectangular-shaped main member dimensioned to readily fit inside the flattened shirt with a first fold line extending longitudinally along one side of said main member from a top edge thereof to a bottom edge thereof and a second fold line extending longitudinally along another side of said main member from the top edge thereof to the bottom edge thereof, said first and second fold lines dividing said main member into two approximately equal side sections and a mid-section;

(b) a first generally rectangular-shaped arm member extending from an upper corner of one side section of the main member and a second generally rectangular-shaped arm member extending from an upper corner of the other side section of the main member wherein each said arm member is dimensioned to accommodate a sleeve of the shirt; and (c) a neck member extending from a center area of the main member's top edge to accommodate a neck opening of the shirt, said neck member further having a hook-line member extending from a center area of said neck member wherein said hook-line member is capable of hooking over a closet rod to suspend the shirt-shaper article therefrom.

9. The shirt-shaper article of claim 8 wherein the main member ranges from about twelve inches to about twenty inches in length and about ten inches to about eighteen inches in width.

10. The shirt-shaper article of claim 9 wherein each fold line in the main member is positioned about two inches to about four inches from a side edge thereof.

11. The shift-shaper article of claim 8 wherein the substantially flat body is a rigid or semi-rigid material.

12. The shirt-shaper article of claim 11 wherein the substantially flat body is formed from cardboard, plastic, or leather.

13. The shirt-shaper article of claim 12 wherein the substantially flat body is an about 0.5 millimeter to about 4 millimeter cardboard.

14. The shirt-shaper article of claim 8 wherein the arm members each extend laterally from the side sections at a downward angle to best accommodate the sleeves of the shirt.

* * * * *